US009193551B2

(12) United States Patent
Kamijo et al.

(10) Patent No.: US 9,193,551 B2
(45) Date of Patent: Nov. 24, 2015

(54) TRANSPORT MECHANISM AND IMAGE FORMING APPARATUS

(71) Applicant: FUJI XEROX CO., LTD., Tokyo (JP)

(72) Inventors: Yasuhiro Kamijo, Kanagawa (JP); Toshitaka Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/266,360

(22) Filed: Apr. 30, 2014

(65) Prior Publication Data

US 2015/0108705 A1 Apr. 23, 2015

(30) Foreign Application Priority Data

Oct. 17, 2013 (JP) ..... 2013-216748

(51) Int. Cl.
*B65H 9/00* (2006.01)

(52) U.S. Cl.
CPC ..... *B65H 9/004* (2013.01); *B65H 2404/725* (2013.01)

(58) Field of Classification Search
CPC ..... B65H 9/004; B65H 9/04; B65H 9/06; B65H 9/08; B65H 2404/121; B65H 2404/122; B65H 2404/725; B65H 3/50; B65H 3/56; B65H 3/565
See application file for complete search history.

(56) References Cited

U.S. PATENT DOCUMENTS

| | | | | |
|---|---|---|---|---|
| 5,233,400 | A * | 8/1993 | Cahill | 399/395 |
| 2008/0143045 | A1* | 6/2008 | Yu et al. | 271/245 |
| 2009/0189338 | A1* | 7/2009 | Yu et al. | 271/229 |
| 2012/0018945 | A1* | 1/2012 | Mori | 271/109 |
| 2013/0213771 | A1* | 8/2013 | Osada et al. | 198/624 |
| 2013/0214480 | A1* | 8/2013 | Watanabe et al. | 271/226 |
| 2013/0241141 | A1* | 9/2013 | Karikusa | 271/227 |
| 2013/0279961 | A1* | 10/2013 | Yang | 399/394 |

FOREIGN PATENT DOCUMENTS

| | | |
|---|---|---|
| JP | A-11-165916 | 6/1999 |
| JP | A-2003-128297 | 5/2003 |

* cited by examiner

*Primary Examiner* — Jeremy R Severson
(74) *Attorney, Agent, or Firm* — Oliff PLC

(57) ABSTRACT

A transport mechanism includes a transport path along which a recording medium is transported, a contact member with which a leading end of the recording medium, which is to be transported along the transport path, is brought into contact, the contact member being capable of moving to a contact position at which the leading end of the recording medium is brought into contact with the contact member or to a retracting position at which the contact member retracts from the transport path, a transport member that transports the recording medium, which has been brought into contact with the contact member, to downstream in a transport direction of the recording medium while rotating in a normal direction, and a rotational force transmission member that transmits a rotational force of the transport member to the contact member and causes the contact member to move to the contact position or the retracting position.

14 Claims, 12 Drawing Sheets

TRANSPORT MECHANISM AND IMAGE FORMING APPARATUS

CROSS-REFERENCE TO RELATED APPLICATIONS

This application is based on and claims priority under 35 USC 119 from Japanese Patent Application No. 2013-216748 filed Oct. 17, 2013.

BACKGROUND

Technical Field

The present invention relates to a transport mechanism and an image forming apparatus.

SUMMARY

According to an aspect of the invention, there is provided a transport mechanism including a transport path along which a recording medium is transported, a contact member with which a leading end of the recording medium, which is to be transported along the transport path, is brought into contact, the contact member being capable of moving to a contact position at which the leading end of the recording medium is brought into contact with the contact member or to a retracting position at which the contact member retracts from the transport path, a transport member that transports the recording medium, which has been brought into contact with the contact member, to downstream in a transport direction of the recording medium while the transport member rotating in a normal direction, and a rotational force transmission member that transmits a rotational force of the transport member to the contact member and causes the contact member to move to the contact position or the retracting position.

BRIEF DESCRIPTION OF THE DRAWINGS

Exemplary embodiments of the present invention will be described in detail based on the following figures, wherein.

DETAILED DESCRIPTION

First Embodiment

Figure 1A:
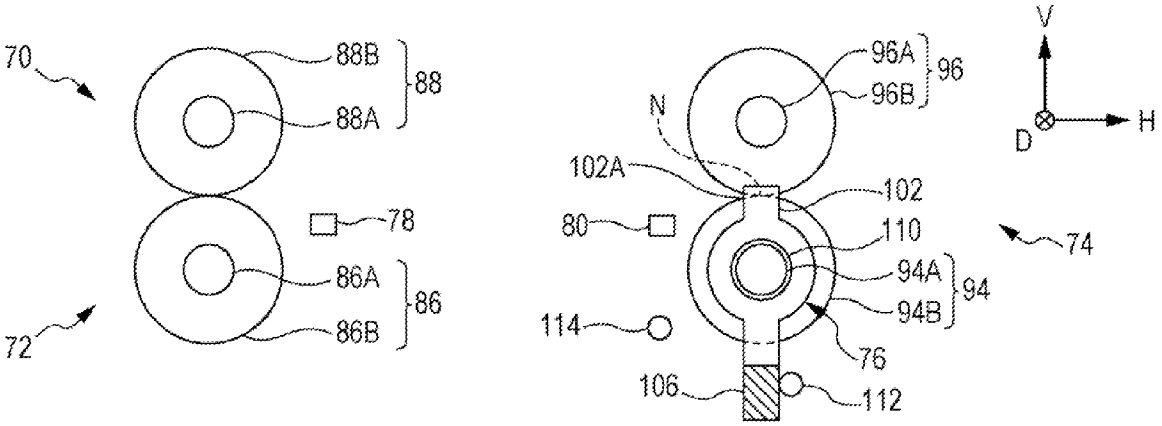
FIGS. 1A and 1B are diagrams illustrating a transport mechanism according to a first exemplary embodiment of the present invention and illustrating a process of transporting a sheet member P when viewed from a side.

Examples of a transport mechanism and an image forming apparatus according to a first exemplary embodiment of the present invention will be described with reference to FIG. 1A to FIG. 7. Note that, in the drawings, arrow V indicates the vertical direction and a top-bottom direction of the image forming apparatus, arrow H indicates the horizontal direction and a width direction of the image forming apparatus, and arrow D indicates the horizontal direction and a depth direction of the image forming apparatus.

(Overall Configuration)

Figure 7:
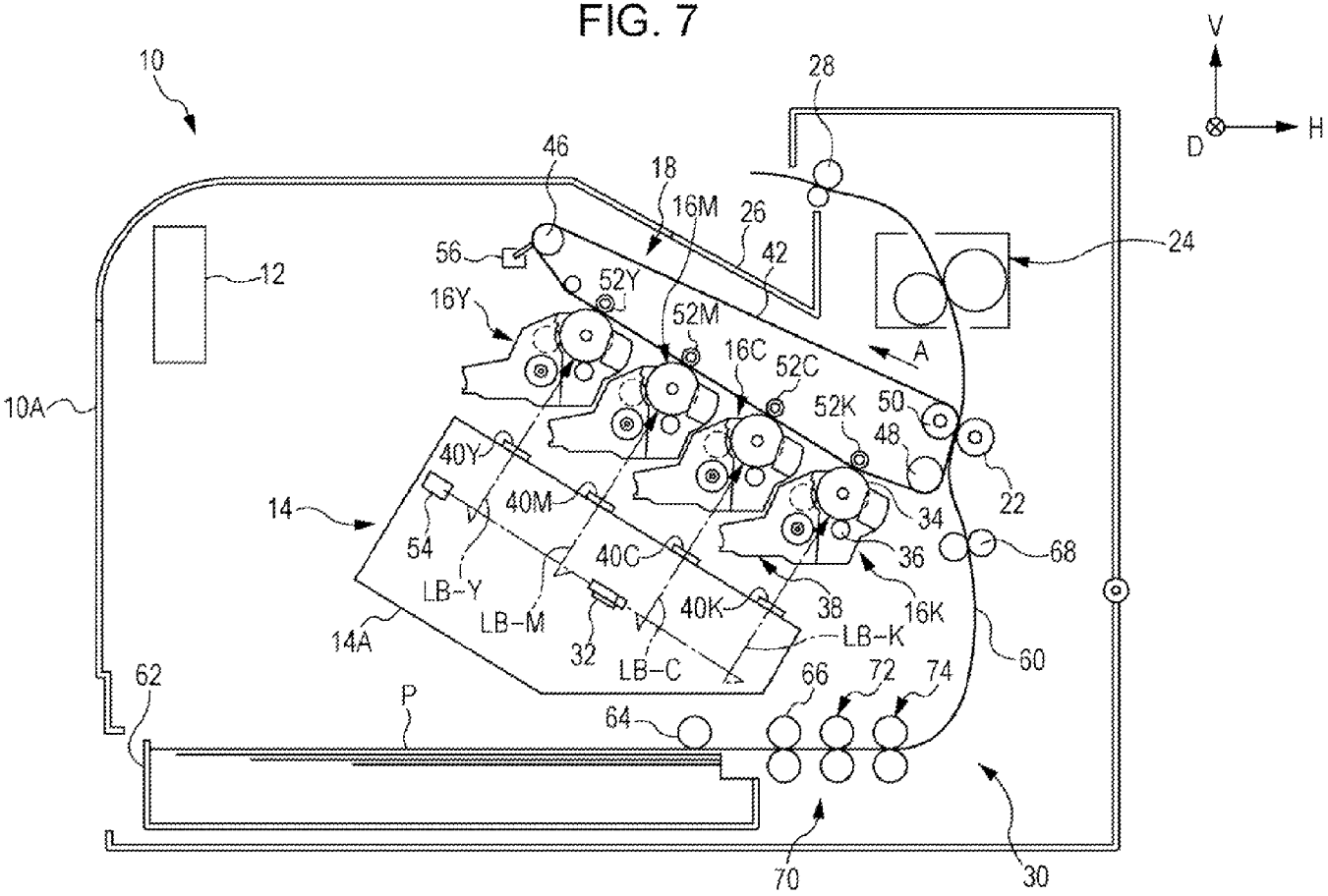
FIG. 7 is a schematic diagram illustrating an image forming apparatus according to the first exemplary embodiment of the present invention.

As illustrated in FIG. 7, an image processing unit 12 that performs image processing on an image data item that is to be input thereto is disposed in an apparatus body 10A of an image forming apparatus 10.

The image processing unit 12 processes an image data item that has been input thereto into gradation image items each of which has one of four colors of yellow (Y), magenta (M), cyan (C), and black (K). An exposure device 14 that receives the gradation image items that have been processed by the image processing unit 12 and performs image exposure by using a laser beam LB is disposed in a central area inside the apparatus body 10A.

Four image forming units 16Y, 16M, 16C and 16K (examples of image forming units) for yellow (Y), magenta (M), cyan (C), and black (K) colors are disposed above the exposure device 14 in the vertical direction and are arranged so as to be spaced apart from one another in a direction that is inclined with respect to the horizontal direction. The image forming units 16Y, 16M, 16C and 16K are removable from the apparatus body 10A. The image forming units 16Y, 16M, 16C and 16K are configured to form toner images of the corresponding colors. Note that in the case where it is not necessary to describe the image forming units 16Y, 16M, 16C and 16K in such a manner as to be distinguished in terms of color, the letters Y, M, C, and K may sometimes be omitted in the following description.

On the other hand, a first transfer unit 18 onto which toner images of different colors that have been formed by the image forming units 16 are to be transferred in such a manner that the toner images are superposed with one another is disposed above the image forming units 16 for different colors in the vertical direction. A second transfer roller 22 (an example of a transfer member) that transfers the toner images, which have been transferred to the first transfer unit 18 in such a manner that the toner images are superposed with one another, onto a sheet member P that serves as a recording medium and that has been transported along a transport path 60 by a supply transport unit 30, which will be described later, is disposed adjacent to the first transfer unit 18 (the right side in FIG. 7).

A fixing device 24 that fixes the toner images that have been transferred to the sheet member P onto the sheet member P by heating the toner images and applying pressure to the toner images is disposed downstream of the second transfer roller 22 in a transport direction of the sheet member P. Ejection rollers 28 that eject the sheet member P to which the toner images have been fixed to an ejection section 26 that is provided in an upper portion of the apparatus body 10A of the image forming apparatus 10 are disposed downstream of the fixing device 24 in the transport direction of the sheet member P.

On the other hand, the supply transport unit 30 that supplies and transports the sheet member P is disposed at a position that is below and adjacent to the exposure device 14 in the vertical direction.

[Image Forming Units]

First, the image forming units 16 will be described.

Each of the image forming units 16 for different colors is configured in a similar manner. In addition, each of the image forming units 16 for different colors includes an image carrier 34 that has a columnar shape and that rotates, a charging member 36 that charges the outer circumferential surface of the image carrier 34, a developing unit 38 that develops, with a developer (toner), an electrostatic latent image that has been formed on the outer circumferential surface of the image carrier 34, which has been charged, by image exposure performed by the above-described exposure device 14 into a toner image, and a cleaning blade (not illustrated) that cleans the outer circumferential surface of the image carrier 34.

[Exposure Device]

The exposure device 14 will now be described.

A polygon mirror 32, which is a rotating polygon mirror, is disposed in a housing 14A of the exposure device 14. Laser beams LB-Y, LB-M, LB-C, and LB-K that are examples of light sources and that are emitted from a semiconductor laser 54 are radiated onto the polygon mirror 32 via a cylindrical lens (not illustrated) and are caused to be deflected and scanned in a scanning direction by the polygon mirror 32. Each of the laser beams LB-Y, LB-M, LB-C, and LB-K that has been caused to be deflected and scanned by the polygon mirror 32 is caused to diagonally scan and irradiate an exposure position on a corresponding one of the image carriers 34 from below via an imaging lens and mirrors (not illustrated).

As described above, the exposure device 14 is configured to diagonally scan and irradiate the image carriers 34 from below. Therefore, there is a possibility of foreign objects such as toner falling onto the exposure device 14 from the developing units 38, which are included in the image forming units 16 for different colors, and the like that are positioned above the exposure device 14. Accordingly, transmission glasses 40Y, 40M, 40C, and 40K that are examples of transmission members each made of transparent glass and that transmit the four laser beams LB-Y, LB-M, LB-C, and LB-K onto the corresponding image carriers 34 of the image forming units 16 for different colors are disposed on a portion of the outer peripheral surface of the housing 14A that faces upward.

[First Transfer Unit and Second Transfer Roller]

The first transfer unit 18 and the second transfer roller 22 will now be described.

The first transfer unit 18 is disposed above the image forming units 16 for different colors in the vertical direction. The first transfer unit 18 includes an endless intermediate transfer belt 42, a driving roller 46 around which the intermediate transfer belt 42 is wound and which is driven so as to rotate, so that the intermediate transfer belt 42 is caused to circulate in the direction of arrow A, a tension-applying roller 48 around which the intermediate transfer belt 42 is wound and exerts a tension on the intermediate transfer belt 42, a driven roller 50 that is disposed above the tension-applying roller 48 in the vertical direction and that is driven by the intermediate transfer belt 42 and rotates, and first transfer rollers 52Y, 52M, 52C, and 52K each of which is disposed at a position on the side opposite to a corresponding one of the image carriers 34 for different colors with the intermediate transfer belt 42 interposed therebetween.

This enables toner images of yellow (Y), magenta (M), cyan (C), and black (K) colors that have been sequentially formed on the image carriers 34 of the corresponding image forming units 16 for different colors to be transferred onto the intermediate transfer belt 42 in such a manner that the toner images are superposed with one another by the first transfer rollers 52Y, 52M, 52C, and 52K.

In addition, a cleaning blade 56 that cleans the outer peripheral surface of the intermediate transfer belt 42 by making contact with the outer peripheral surface of the intermediate transfer belt 42 is disposed at a position on the side opposite to the driving roller 46 with the intermediate transfer belt 42 interposed therebetween. The second transfer roller 22 that transfers the toner images that have been transferred to the intermediate transfer belt 42 onto the sheet member P that is to be transported is disposed at a position on the side opposite to the driven roller 50 with the intermediate transfer belt 42 interposed therebetween.

With this configuration, the toner images of yellow (Y), magenta (M), cyan (C), and black (K) colors that have been transferred to the intermediate transfer belt 42 in such a manner that the toner images are superposed with one another are transported by the intermediate transfer belt 42. The toner images that are transported are to be transferred in a second transfer process onto the sheet member P that has been transported along the transport path 60 by the supply transport unit 30, which will be described below, while being nipped between the driven roller 50 and the second transfer roller 22.

[Supply Transport Unit]

The supply transport unit 30 that supplies and transports the sheet member P will now be described.

The supply transport unit 30 is disposed below the exposure device 14 in the vertical direction in the apparatus body 10A and includes a sheet feed member 62 on which multiple sheet members P are to be stacked.

In addition, the supply transport unit 30 includes a sheet feed roller 64 that sends out the sheet members P that are stacked on the sheet feed member 62 to the transport path 60, separation rollers 66 that separate the sheet members P, which have been sent out by the sheet feed roller 64, one by one, a transport mechanism 70 that corrects inclination (posture) of one of the sheet members P (corrects skew) and adjusts the timing of transportation of the sheet member P, and transport rollers 68 that transport the sheet member P whose inclination has been corrected by the transport mechanism 70 to downstream in the transport direction of the sheet member P (hereinafter simply referred to as a position downstream in a sheet transport direction).

With this configuration, one of the sheet members P that is supplied from the sheet feed member 62 is to be sent out to a position at which the intermediate transfer belt 42 and the second transfer roller 22 are brought into contact with each other (a second transfer position) by the transport mechanism 70 at a predetermined timing. Note that details of the transport mechanism 70 will be described later.

(Effects of Overall Configuration)

With this configuration, an image is formed on one of the sheet members P in the following manner.

First, gradation image items of different colors are sequentially output from the image processing unit 12 to the exposure device 14. Then, each of the laser beams LB-Y, LB-M, LB-C, and LB-K that are emitted from the exposure device 14 in accordance with the gradation image items is caused to scan and irradiate the outer circumferential surface of the corresponding image carrier 34, which has been charged by the charging member 36 (the outer circumferential surfaces of the image carriers 34 are exposed with the corresponding laser beams LB-Y, LB-M, LB-C, and LB-K in the scanning direction). As a result, an electrostatic latent image is formed on the outer circumferential surface of each of the image carriers 34. The electrostatic latent images that have been formed on the image carriers 34 are developed by the corresponding developing units 38 for different colors and visualized as toner images of yellow (Y), magenta (M), cyan (C), and black (K) colors.

The toner images of yellow (Y), magenta (M), cyan (C), and black (K) colors that have been formed on the corresponding image carriers 34 are transferred onto the intermediate transfer belt 42, which circulates, in such a manner that the toner images are superposed with one another by the first transfer rollers 52Y, 52M, 52C, and 52K of the first transfer unit 18.

The toner images of different colors that have been transferred to the intermediate transfer belt 42, which circulates, in such a manner that the toner images are superposed with one another are transferred in a second transfer process by the second transfer roller 22 onto one of the sheet members P that has been transported along the transport path 60 by the sheet feed roller 64, the separation rollers 66, and the transport mechanism 70 from the sheet feed member 62.

The sheet member P to which the toner images have been transferred is transported to the fixing device 24. Then, the toner images are fixed onto the sheet member P by the fixing device 24. The sheet member P to which the toner images have been fixed is ejected to the ejection section 26 by the ejection rollers 28.

(Configuration of Principal Portion)

The transport mechanism 70 will now be described.

As illustrated in FIG. 1A and FIG. 7, the transport mechanism 70 includes a pair of transport rollers 72 that are disposed downstream of the separation rollers 66 in the sheet transport direction and a pair of registration rollers 74 that are examples of transport members and that are disposed downstream of the pair of transport rollers 72 in the sheet transport direction. In addition, the transport mechanism 70 includes a contact member 76 that may move to a contact position at which a leading end of one of the sheet members P is brought into contact with the contact member 76 or to a retracting position at which the contact member 76 allows the sheet member P to be transported. Furthermore, the transport mechanism 70 includes a sensor 78 that senses a leading end of one of the sheet members P that is to be transported and a sensor 80 that senses a trailing end of the sheet member P, which is to be transported. The sensor 78 and the sensor 80 are disposed between the pair of transport rollers 72 and the pair of registration rollers 74, and the sensor 78 is disposed on the side of the pair of transport rollers 72, and the sensor 80 is disposed on the side of the pair of registration rollers 74.

Figure 5:
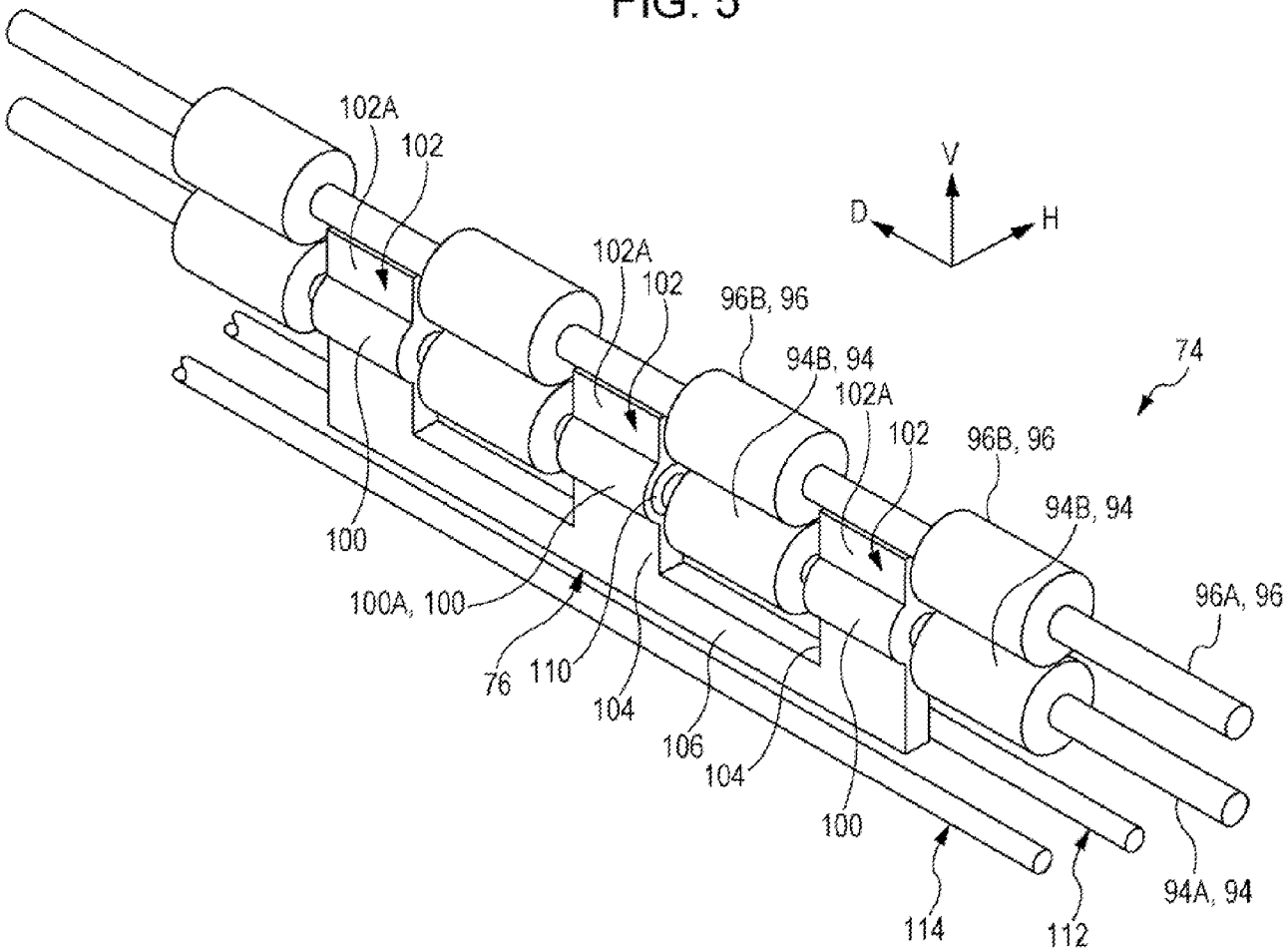
FIG. 5 is a perspective view illustrating registration rollers and a contact member that are used in the transport mechanism according to the first exemplary embodiment of the present invention.
Figure 6:
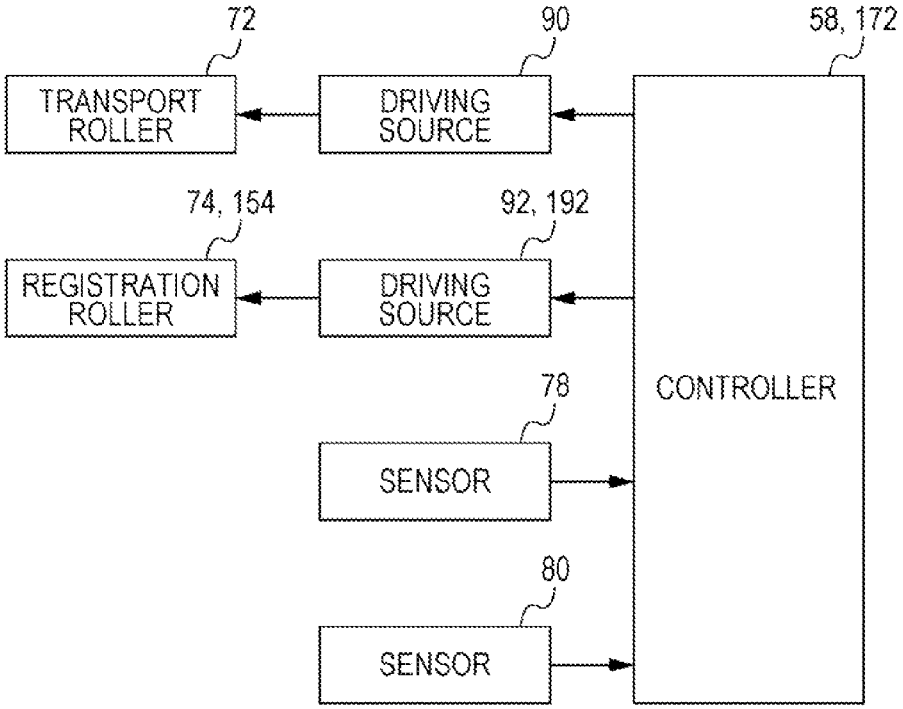
FIG. 6 is a block diagram illustrating control of each unit performed by a controller that is included in the transport mechanism according to the first exemplary embodiment of the present invention.

Note that the operation of each member included in the transport mechanism 70 is controlled by a controller 58 (see FIG. 6). FIGS. 1A and 1B, FIG. 2A, FIG. 3B, and FIG. 5 illustrate a state where the contact member 76 is positioned at the contact position, and FIG. 2B and FIG. 3A illustrate a state where the contact member 76 is positioned at the retracting position.

[Pair of Transport Rollers]

As illustrated in FIG. 1A, the pair of transport rollers 72 include a driving roller 86 that rotates and has a rotation axis parallel to the depth direction of the image forming apparatus 10 and a driven roller 88 that rotates and is driven by the driving roller 86, which rotates. The driving roller 86 and the driven roller 88 are arranged next to each other in the top-bottom direction of the image forming apparatus 10, and the driving roller 86 is disposed below the driven roller 88 in the top-bottom direction of the image forming apparatus 10.

Figure 4A:
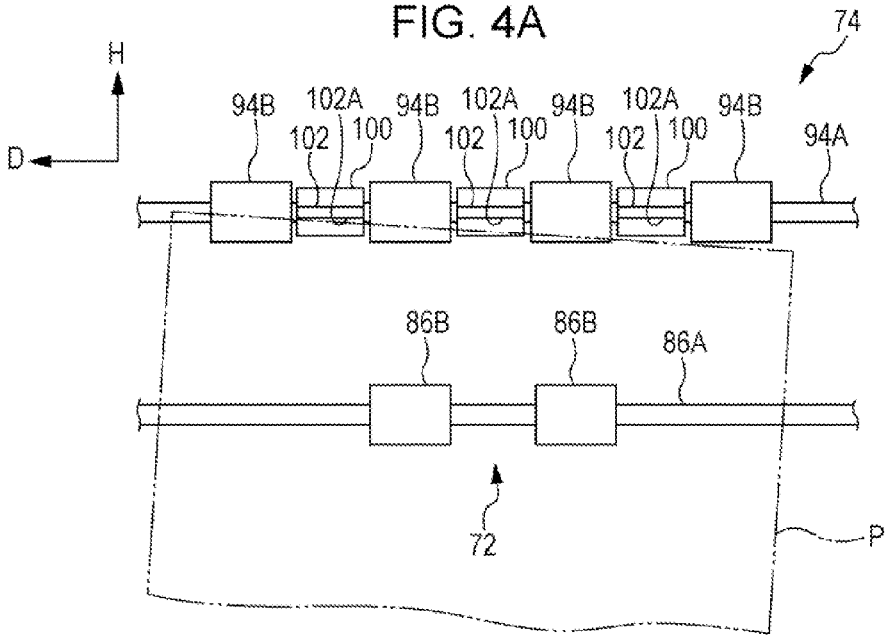
FIGS. 4A and 4B are diagrams illustrating the transport mechanism according to the first exemplary embodiment of the present invention and illustrating a process of transporting the sheet member P when viewed from above.

The driving roller 86 includes a shaft portion 86A that has a columnar shape and plural (two in the first exemplary embodiment) roller portions 86B each of which is formed in a cylindrical shape and attached to the shaft portion 86A (see FIG. 4A). A driving source 90 that applies a force that causes the shaft portion 86A to rotate to the shaft portion 86A is controlled by the controller 58 (see FIG. 6).

Similarly to the driving roller 86, the driven roller 88 includes a shaft portion 88A that has a columnar shape and plural (two in the first exemplary embodiment) roller portions 88B each of which is formed in a cylindrical shape and attached to the shaft portion 88A.

[Pair of Registration Rollers]

As illustrated in FIG. 1A and FIG. 5, the pair of registration rollers 74 include a driving roller 94 (an example of a rotary member) that rotates and has a rotation axis parallel to the depth direction of the image forming apparatus 10 and a driven roller 96 (an example of a rotary member) that rotates and is driven by the driving roller 94, which rotates. The driving roller 94 and the driven roller 96 are arranged next to each other in the top-bottom direction of the image forming apparatus 10, and the driving roller 94 is disposed below the driven roller 96 in the top-bottom direction of the image forming apparatus 10.

The driving roller 94 includes a shaft portion 94A that has a columnar shape and plural (four in the first exemplary embodiment) roller portions 943 each of which is formed in a cylindrical shape and attached to the shaft portion 94A. The roller portions 94B are arranged in such a manner as to be spaced apart from one another at a similar pitch (see FIG. 4). A driving source 92 that transmits to the shaft portion 94A a force that causes the shaft portion 94A to rotate is controlled by the controller 58 (see FIG. 6).

The driven roller 96 includes a shaft portion 96A that has a columnar shape and plural (four in the first exemplary embodiment) roller portions 96B each of which is formed in a cylindrical shape and attached to the shaft portion 96A. The roller portions 96B and the roller portions 94B of the driving roller 94 have similar shapes, and the roller portions 96B are arranged at a pitch similar to that of the roller portions 94B in such a manner as to be in contact with a corresponding one of the roller portions 94B. In this manner, nip parts N in each of which the driving roller 94 and the driven roller 96 are in contact with each other are defined.

[Contact Member]

As illustrated in FIG. 5, the contact member 76 includes three cylindrical portions 100 each of which has a cylindrical shape and in each of which an insertion hole in which the shaft portion 94A is received is formed, each of the cylindrical portions 100 being disposed between a corresponding two of the roller portions 94B that are adjacent to each other. In addition, the contact member 76 includes upward projecting portions 102 each of which projects upward in the top-bottom direction of the image forming apparatus 10 from a corresponding one of the cylindrical portions 100, downward projecting portions 104 each of which projects downward in the top-bottom direction of the image forming apparatus 10 from a corresponding one of the cylindrical portions 100, and a connecting portion 106 that extends in the depth direction of the image forming apparatus 10 and connects lower end portions of the downward projecting portions 104. The contact member 76 is capable of performing a rotational movement about the cylindrical portions 100 with respect to the shaft portion 94A.

Each of the cylindrical portions 100 is formed in such a manner as to have a diameter that is smaller than that of a corresponding one of the roller portions 94B, and an end of each of the upward projecting portions 102 extends to a position between a corresponding two of the roller portions 96B that are adjacent to each other. Each of the upward projecting portions 102 has a rectangular contact surface 102A (an example of a surface). The contact member 76 is positioned at the contact position, so that each of the contact surfaces 102A is positioned upstream of the corresponding nip part N, which is defined by the driving roller 94 and the driven roller 96 and which is a contact position at which the driving roller 94 and the driven roller 96 are in contact with each other (see FIG. 1A), in the sheet transport direction, and a leading end of one of the sheet members P that is to be transported is brought into contact with the contact surfaces 102A.

[Others]

As illustrated in FIG. 5, a torque limiter 110 is disposed between a cylindrical portion 100A that is the cylindrical portion 100 positioned in the middle among the three cylindrical portions 100 and the shaft portion 94A. The torque limiter 110 is an example of a forward transmission member and a backward transmission member that transmits a rotational force of the shaft portion 94A that rotates to the cylindrical portion 100A and stops transmitting the rotational force when the rotational force, which is to be transmitted, becomes larger than a predetermined force.

As illustrated in FIG. 1A and FIG. 5, a positioning bar 112 and a positioning bar 114 each of which has a columnar shape and extends in the depth direction of the image forming apparatus 10 are disposed in such a manner that the connecting portion 106 is interposed between the positioning bar 112 and the positioning bar 114 when viewed from the depth direction of the image forming apparatus 10.

Figure 1B:
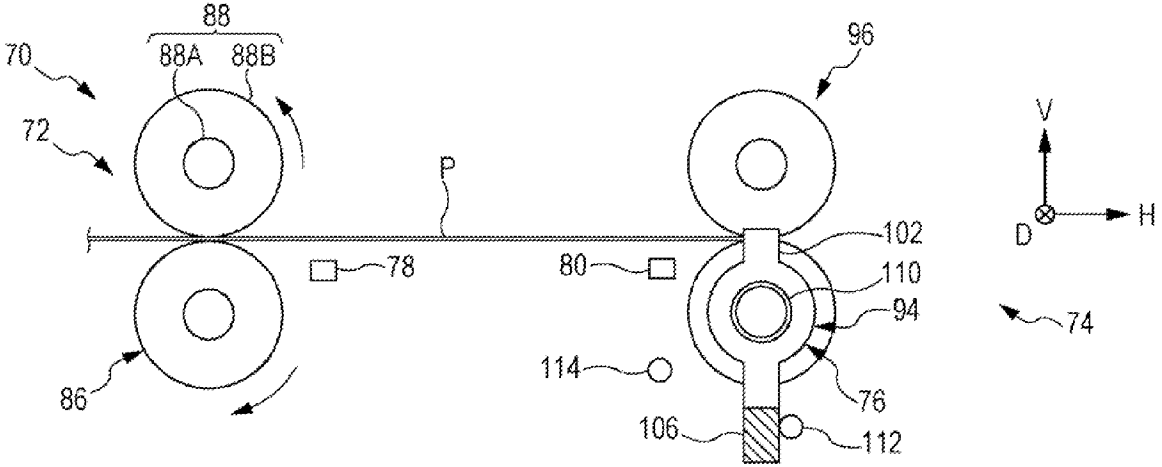

In a state where the connecting portion 106 is in contact with the positioning bar 112, as illustrated in FIG. 1B, the contact member 76 is positioned at the contact position, and a leading end of one of the sheet members P that is transported by the pair of transport rollers 72 is brought into contact with the contact surfaces 102A of the upward projecting portions 102.

On the other hand, in a state where the connecting portion 106 is in contact with the positioning bar 114 by rotating the contact member 76, as illustrated in FIG. 2B, the contact member 76 is positioned at the retracting position. As a result, the contact member 76 allows one of the sheet members P to be transported by the pair of transport rollers 72 and the pair of registration rollers 74.

Note that the configuration of the controller 58 will be described together with effects of the configuration of a principal portion, which will be described below.

(Effects of Configuration of Principal Portion)

Effects of the transport mechanism 70 and the like will now be described.

First, when the image forming apparatus 10 is not in operation, as illustrated in FIG. 1A, rotation of the pair of transport rollers 72 and the pair of registration rollers 74 is stopped, and the contact member 76 is positioned at the contact position (an initial state).

When the image forming apparatus 10 is operating and transports one of the sheet members P to downstream in the sheet transport direction, as illustrated in FIG. 1B, the controller 58 causes the driving source 90 to operate (see FIG. 6) and causes the pair of transport rollers 72 to rotate in a normal direction (a direction in which the sheet member P is transported to downstream in the sheet transport direction). The pair of transport rollers 72, which rotate, transport the sheet member P to the pair of registration rollers 74. Then, a leading end of the sheet member P, which is transported, is brought into contact with the contact surfaces 102A of the upward projecting portions 102 of the contact member 76 that is positioned at the contact position.

Here, in the case where the sheet member P, which is transported, is inclined with respect to the sheet transport direction, as illustrated in FIG. 4A, the leading end of the sheet member P is brought into contact only with the contact surface 102A of the upward projecting portion 102 of the contact member 76 that is positioned on an end side (the left side in FIG. 4A).

Figure 2A:
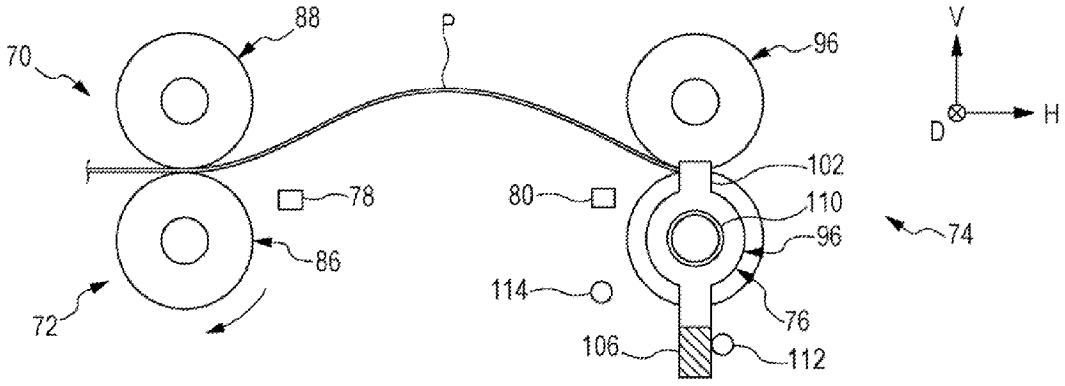
FIGS. 2A and 2B are diagrams illustrating the transport mechanism according to the first exemplary embodiment of the present invention and illustrating a process of transporting the sheet member P when viewed from a side.
Figure 2B:
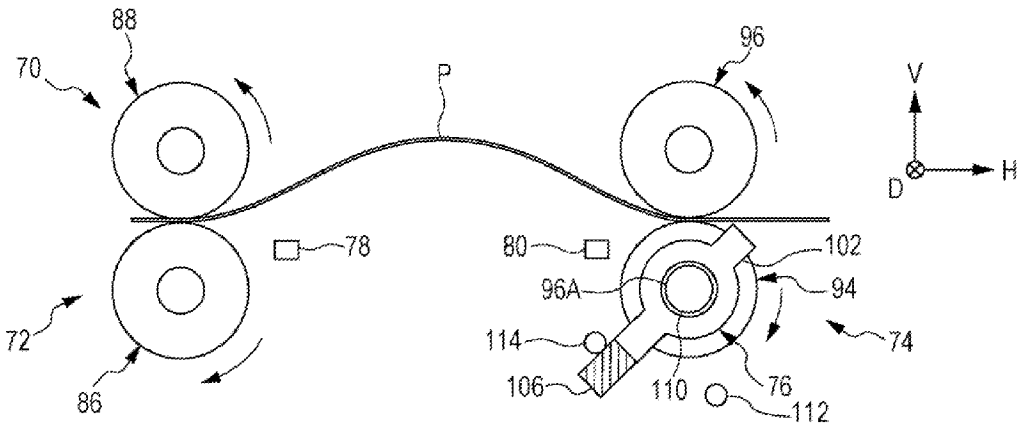
Figure 3A:
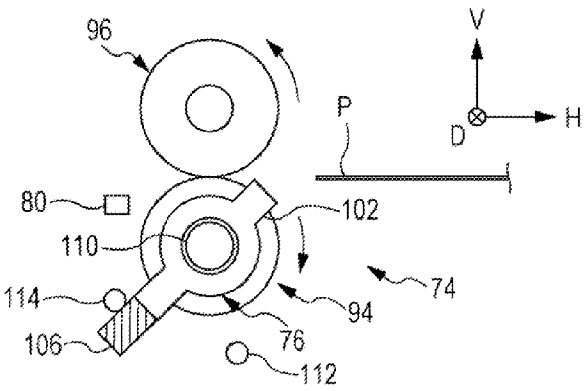
FIGS. 3A and 3E are diagrams illustrating the transport mechanism according to the first exemplary embodiment of the present invention and illustrating a process of transporting the sheet member P when viewed from a side.
Figure 3A:
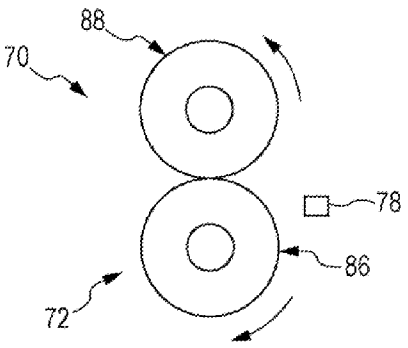

The controller 58 causes the pair of transport rollers 72 to further rotate in a state where the leading end of the sheet member P is in contact with the contact surface 102A as illustrated in FIG. 2A. As a result, the sheet member P having the leading end thereof in contact with the contact surface 102A is lifted up between the pair of transport rollers 72 and the pair of registration rollers 74 in such a manner as to have a loop shape, and the leading end of the sheet member P is pressed against the contact surfaces 102A of the upward projecting portions 102.

Figure 4B:
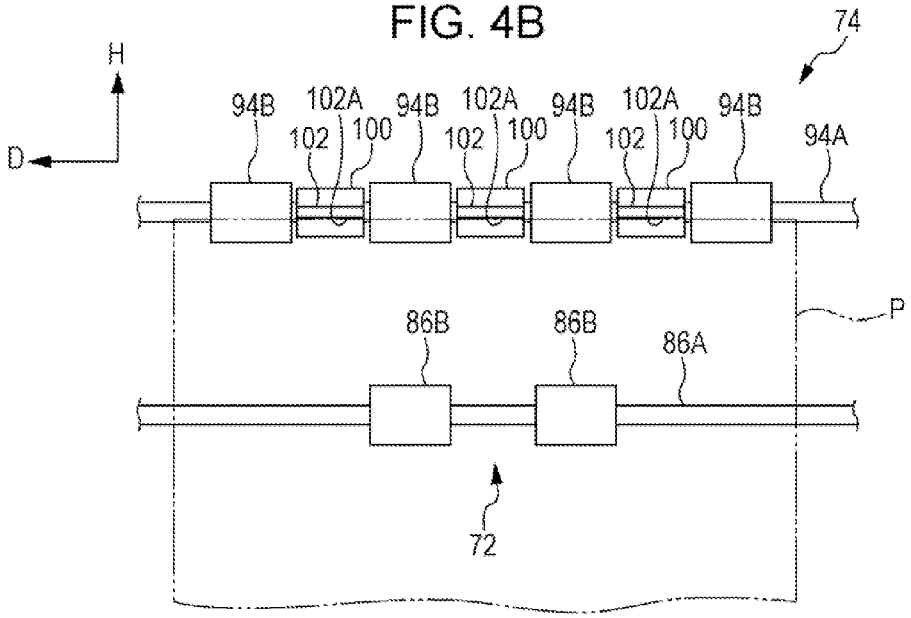

The controller 58 receives sensed information that is obtained by the sensor 78 by sensing the leading end of the sheet member P, and after the leading end of the sheet member P has been pressed against the contact surfaces 102A for a predetermined period of time from the time when the controller 58 receives the sensed information, the controller 58 causes the driving source 90 not to operate and stops the rotation of the pair of transport rollers 72. The leading end of the sheet member P is pressed against the contact surfaces 102A in this manner, and as a result, as illustrated in FIG. 4B, the leading end of the sheet member P is brought into contact with all of the contact surfaces 102A, and the inclination of the sheet member P, which is transported, (the inclination of the sheet member P with respect to the transport direction of the sheet member P) is corrected. Note that, in FIGS. 4A and 4B, the driven rollers 88 and 96 are not illustrated so that the position of the leading end of the sheet member P is easily recognized.

In addition, as illustrated in FIG. 2B, the controller 58 causes the driving source 90 and the driving source 92 to operate in accordance with the timing of transferring toner images onto the sheet member P whose inclination has been corrected and causes the pair of transport rollers 72 and the pair of registration rollers 74 to rotate in the normal direction.

The pair of registration rollers 74 are caused to rotate in the normal direction, so that a rotational force in the normal direction is transmitted from the shaft portion 96A to the contact member 76 via the torque limiter 110.

The rotational force in the normal direction is transmitted to the contact member 76, so that the contact member 76 rotates in the normal direction (a clockwise direction in FIG. 2B), and the connecting portion 106 is brought into contact with the positioning bar 114. As a result, transmission of the rotational force from the torque limiter 110 is released, and the contact member 76 is positioned at the retracting position at which the contact member 76 allows the sheet member P to be transported.

The pair of transport rollers 72 and the pair of registration rollers 74 rotate in a state where the contact member 76 has been moved to the retracting position, so that, as illustrated in FIG. 2B and FIG. 3A, the sheet member P is transported to downstream in the sheet transport direction.

Figure 3B:
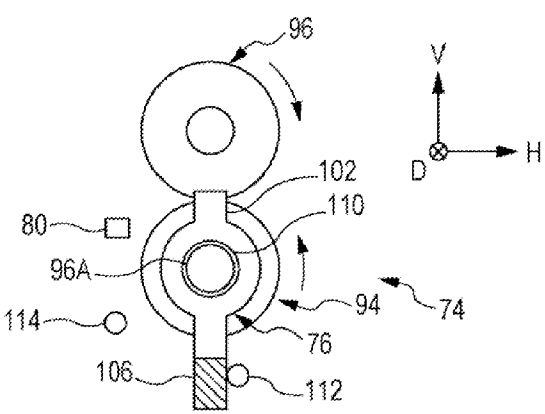
Figure 3B:
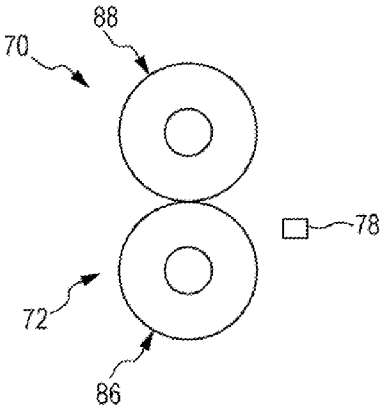

The controller 58 receives sensed information that is obtained by the sensor 80 by sensing the trailing end of the sheet member P, which is transported, and after a period of time required for the sheet member P to be sent out from the pair of registration rollers 74 has passed from the time when the controller 58 receives the sensed information, as illustrated in FIG. 3B, the controller 58 causes the driving source 90 not to operate and stops the rotation of the pair of transport rollers 72. In addition, the controller 58 controls the driving source 92 and causes the pair of registration rollers 74 to rotate in an opposite direction (a direction opposite to the normal direction).

The pair of registration rollers 74 are caused to rotate in the opposite direction, so that a rotational force in the opposite direction is transmitted from the shaft portion 96A to the contact member 76 via the torque limiter 110.

The rotational force in the opposite direction is transmitted to the contact member 76, so that the contact member 76 rotates in the opposite direction (a counterclockwise direction in FIG. 3B), and the connecting portion 106 is brought into contact with the positioning bar 112. As a result, the contact member 76 moves to the contact position. Then, the controller 58 causes the driving source 92 not to operate and stops the rotation of the pair of registration rollers 74. In this manner, the transport mechanism 70 is recovered to the initial state.

The above-described process is repeated, so that a predetermined number of the sheet members P whose inclination has been corrected are transported to downstream in the sheet transport direction.

As described above, inclination of one of the sheet members P is corrected by bringing the sheet member P into contact with the contact surfaces 102A of the upward projecting portions 102 of the contact member 76, and a rotational force of the shaft portion 96A that rotates in the normal direction is transmitted to the contact member 76, so that the contact member 76 moves from the contact position to the retracting position. Therefore, inclination of the sheet members P, which is transported, is corrected while the number of components is reduced as compared with the case where a dedicated driving source for causing the contact member 76 to move from the contact position to the retracting position is provided. In other words, in a configuration in which the contact member 76 is moved from the contact position to the retracting position after bringing a leading end of one of the sheet members P into contact with the contact member 76, the number of driving sources is reduced as compared with the case where the contact member 76 is driven so as to move between the contact position and the retracting position, and the pair of registration rollers 74, which transport the sheet member P, is driven so as to rotate by using different driving sources.

A rotational force of the shaft portion 96A that rotates in the opposite direction is transmitted from the shaft portion 96A to the contact member 76, so that the contact member 76 moves from the retracting position to the contact position. Therefore, the number of components is reduced as compared with the case where a dedicated driving source for causing the contact member 76 to move from the retracting position to the contact position is provided.

In addition, in the image forming apparatus 10, inclination of one of the sheet members P is corrected, so that occurrence of obliquely transferring toner images onto the sheet member P is suppressed.

In a state where the contact member 76 is positioned at the contact position, the contact surfaces 102A with which a leading end of one of the sheet members P, which is to be transported, is to be brought into contact are positioned further upstream than the corresponding nip parts N, which are defined by the driving roller 94 and the driven roller 96, in the sheet transport direction. As a result, the leading end of the sheet member P is brought into contact with the contact surfaces 102A of the contact member 76 without separating the driving roller 94 and the driven roller 96 from each other.

Second Embodiment

Examples of a transport mechanism and an image forming apparatus according to the second exemplary embodiment of the present invention will now be described with reference to FIG. 8A to FIG. 12. Note that members and the like that are the same as those of the first exemplary embodiment are denoted by the same reference numerals, and descriptions thereof will be omitted, and portions that are different from those of the first exemplary embodiment will be described.

(Configuration)

Figure 8A:
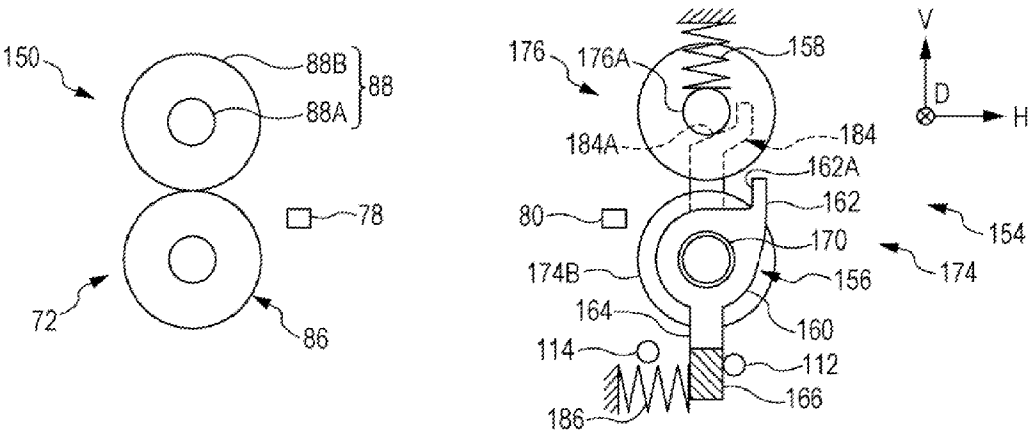
FIGS. 8A and 8B are diagrams illustrating a transport mechanism according to a second exemplary embodiment of the present invention and illustrating a process of transporting the sheet member P when viewed from a side.

As illustrated in FIG. 8A, a transport mechanism 150 according to the second exemplary embodiment includes a pair of registration rollers 154 that are examples of transport members and that are positioned further downstream than a pair of transport rollers 72 in the sheet transport direction. In addition, the transport mechanism 150 includes a contact member 156 that may move to a contact position at which a leading end of a sheet member P, which is transported, is brought into contact with the contact member 156 or to a retracting position at which the contact member 156 allows the sheet member P to be transported.

Figure 8B:
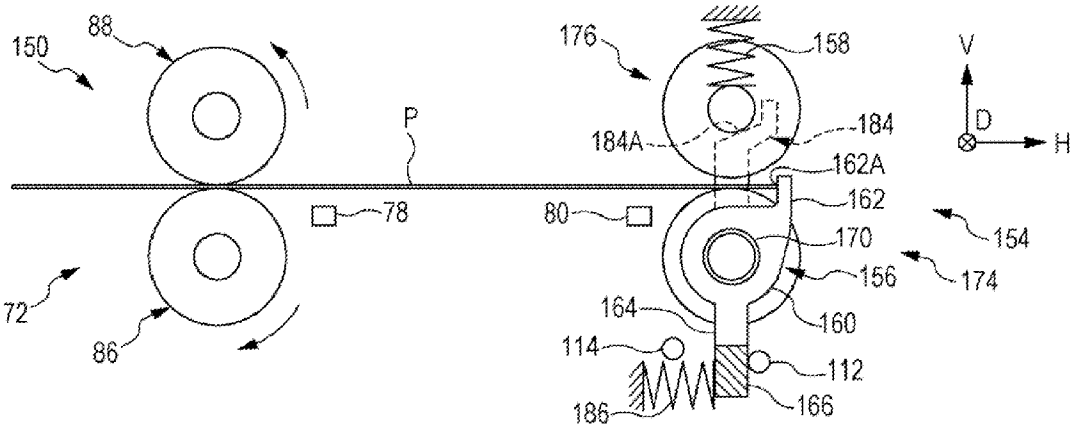
Figure 9A:
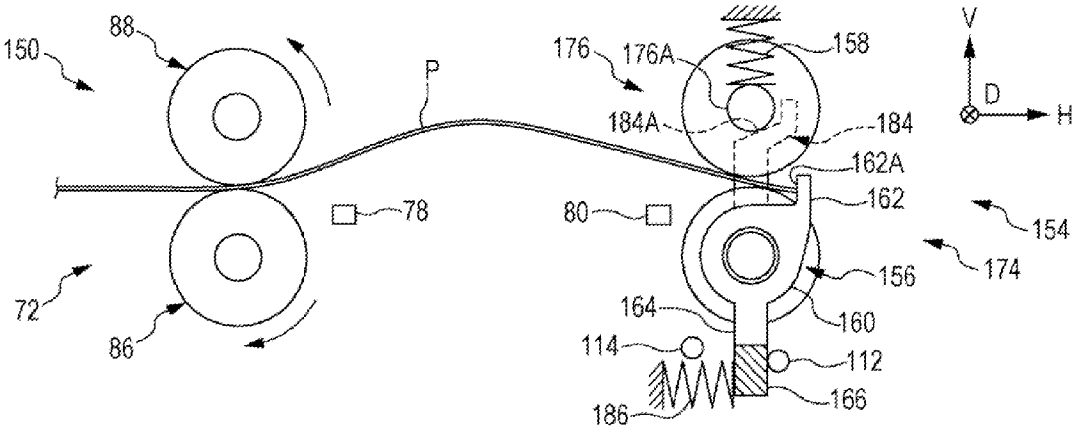
FIGS. 9A and 9B are diagrams illustrating the transport mechanism according to the second exemplary embodiment of the present invention and illustrating a process of transporting the sheet member P when viewed from a side.
Figure 9B:
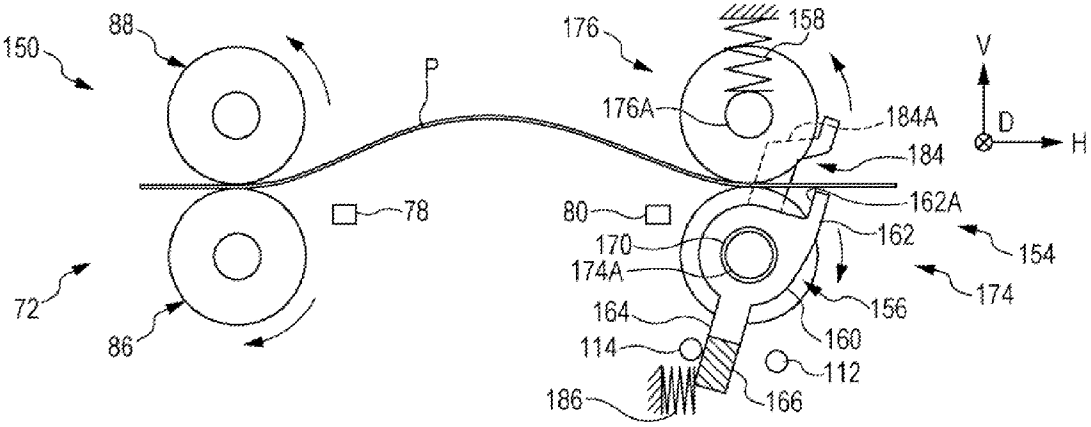
Figure 10A:
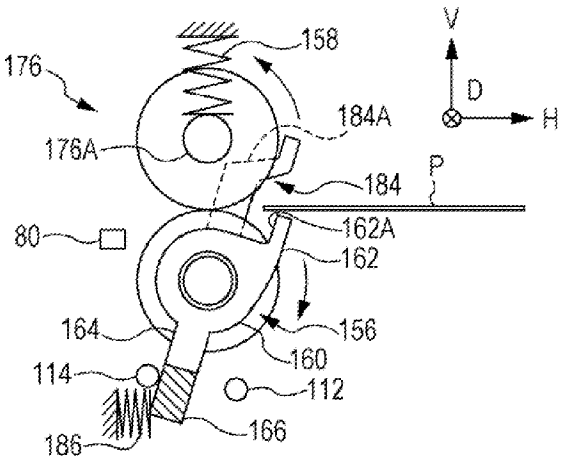
FIGS. 10A and 10B are diagrams illustrating the transport mechanism according to the second exemplary embodiment of the present invention and illustrating a process of transporting the sheet member P when viewed from a side.
Figure 10A:
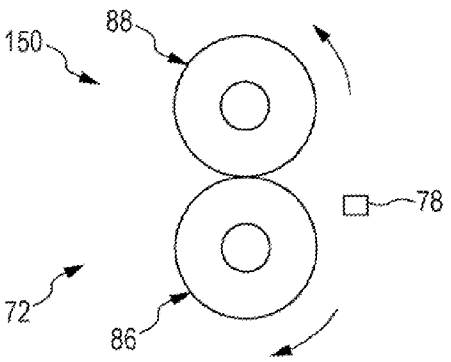

Note that FIGS. 8A and 8B, FIG. 9A, FIG. 10B, FIG. 11 and FIG. 12 illustrate a state where the contact member 156 is positioned at the contact position, and FIG. 9B and FIG. 10A illustrate a state where the contact member 156 is positioned at the retracting position.

[Pair of Registration Rollers]

Figure 12:
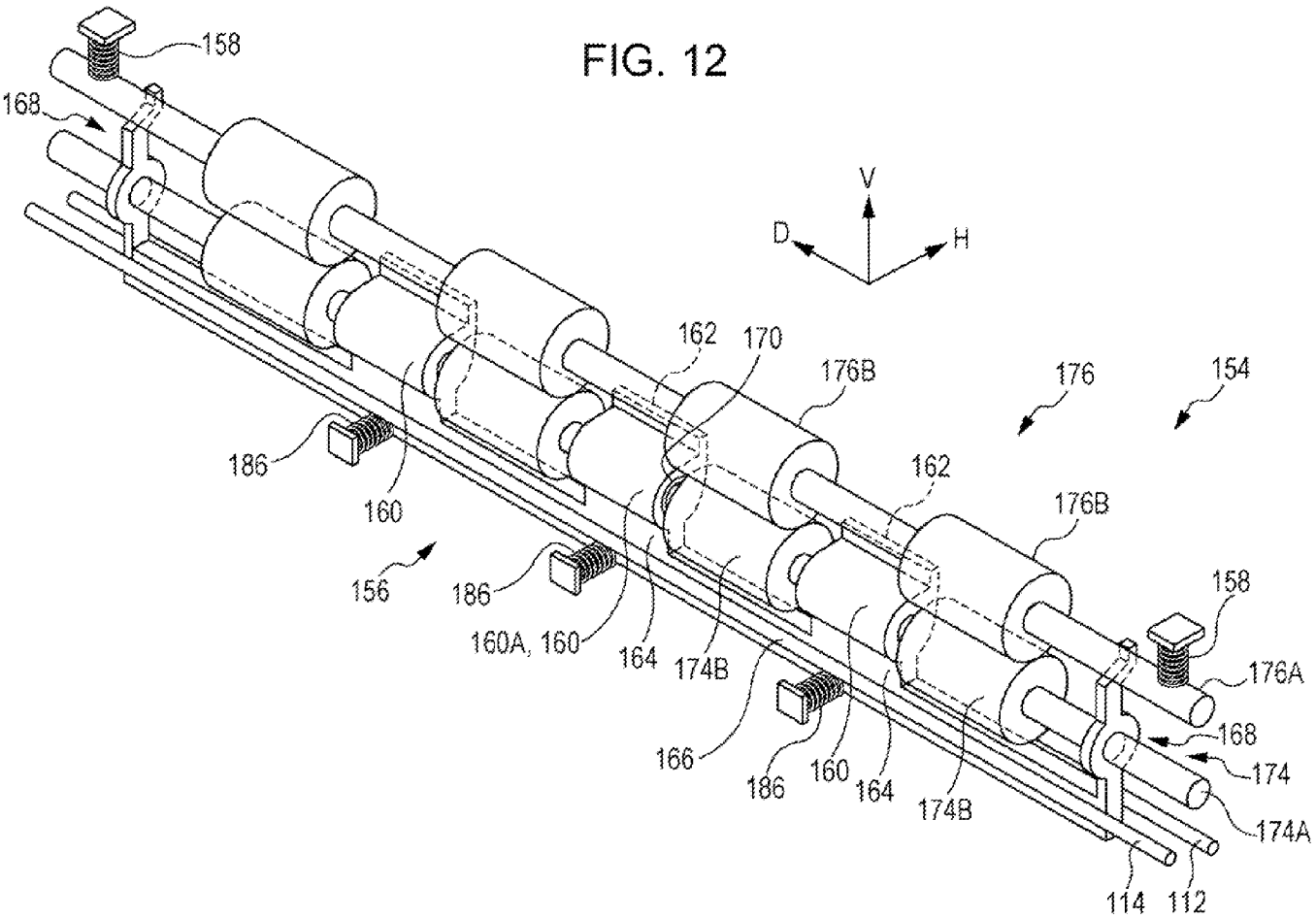
FIG. 12 is a perspective view illustrating the registration rollers and the contact member, which are used in the transport mechanism according to the second exemplary embodiment of the present invention.

As illustrated in FIG. 12, the pair of registration rollers 154 include a driving roller 174 that rotates and has a rotation axis parallel to the depth direction of the image forming apparatus and a driven roller 176 that rotates and is driven by the driving roller 174, which rotates. The driving roller 174 and the driven roller 176 are arranged next to each other in the top-bottom direction of the image forming apparatus, and the driving roller 174 is disposed below the driven roller 176 in the top-bottom direction of the image forming apparatus.

The driving roller 174 includes a shaft portion 174A that has a columnar shape and plural (four in the second exemplary embodiment) roller portions 174B each of which is formed in a cylindrical shape and attached to the shaft portion 174A. The roller portions 174B are arranged in such a manner as to be spaced apart from one another at a similar pitch. A driving source 192 that applies to the shaft portion 174A a force that causes the shaft portion 174A to rotate is controlled by a controller 172 (see FIG. 6).

The driven roller 176 includes a shaft portion 176A that has a columnar shape and plural (four in the second exemplary embodiment) roller portions 176B each of which is formed in a cylindrical shape and attached to the shaft portion 176A. The roller portions 176 and the roller portions 174B of the driving roller 174 have similar shapes, and the roller portions 176B are arranged at a pitch similar to that of the roller portions 174B in such a manner as to be in contact with a corresponding one of the roller portions 174B.

The driven roller 176 is movably supported by a guiding member (not illustrated), which guides the driven roller 176 in the top-bottom direction of the image forming apparatus, in such a manner as to be positioned at a contact position at which the driven roller 176 is in contact with the driving roller 174 (see FIG. 9B) or a separation position at which the driven roller 176 is separated from the driving roller 174 (see FIG. 8A). In addition, coil springs 158 that are examples of urging members that urge the driven roller 176 toward the side of the driving roller 174 are disposed at end portions of the shaft portion 176A of the driven roller 176. More specifically, bearings (not illustrated) that rotatably support the shaft portion 176A are disposed at end portions of the shaft portion 176A, and the coil springs 158 urge the driven roller 176 toward the side of the driving roller 174 via the bearings.

[Contact Member]

As illustrated in FIG. 12, the contact member 156 includes three cylindrical portions 160 each of which has a cylindrical shape and in each of which an insertion hole in which the shaft portion 174A is received is formed, each of the cylindrical portions 160 being disposed between a corresponding two of the roller portions 174B that are adjacent to each other. In addition, as illustrated in FIG. 8A, the contact member 156 includes inclined projecting portions 162 that project obliquely upward to the right side in FIG. 8A from the corresponding cylindrical portions 160 and downward projecting portions 164 that project downward in the top-bottom direction of the image forming apparatus from the corresponding cylindrical portions 160. In addition, the contact member 156 includes a connecting portion 166 that extends in the depth direction of the image forming apparatus and connects lower end portions of the downward projecting portions 164 and includes retracting portions 168 that are formed at end portions of the connecting portion 166. The contact member 156 is capable of performing a rotational movement about the cylindrical portions 160 with respect to the shaft portion 174A.

Each of the cylindrical portions 160 is formed in such a manner as to have a diameter that is smaller than that of a corresponding one of the roller portions 174B, and in a state where the contact member 156 is positioned at the contact position, the position of an end of each of the inclined projecting portions 162 is further upstream than the position of the top end of the corresponding roller portion 174B in the top-bottom direction of the image forming apparatus. Each of the inclined projecting portion 162 has a rectangular contact surface 162A with which the leading end of the sheet member P, which is to be transported, is brought into contact as a result of the contact member 156 being positioned at the contact position.

In addition, as illustrated in FIG. 12, the end portions of the connecting portion 166 extend in the depth direction of the image forming apparatus with respect to the downward projecting portions 164. The retracting portions 168 that enable the driven roller 176, which is positioned at the contact position by an urging force of the coil springs 158, to move to the separation position are formed in the end portions of the connecting portion 166.

Figure 11:
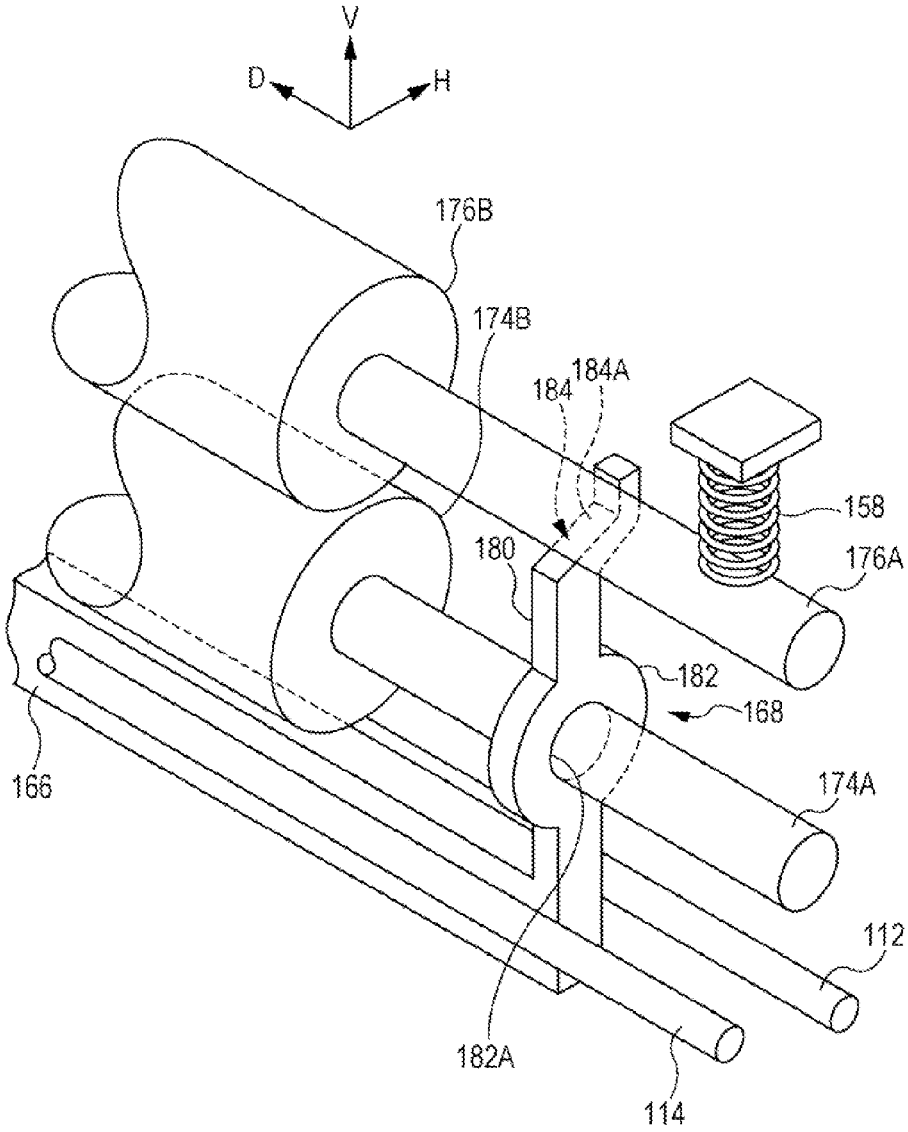
FIG. 11 is an enlarged perspective view illustrating registration rollers and a contact member that are used in the transport mechanism according to the second exemplary embodiment of the present invention.

As illustrated in FIG. 11, each of the retracting portions 168 includes an extended portion 180 that extends upward from an end of the connecting portion 166 and a doughnut-shaped support portion 182 that has an insertion hole 182A that is formed in a central area of the extended portion 180 in the longitudinal direction of the extended portion 180 and in which the shaft portion 174A is received. In addition, each of the retracting portions 168 includes a contact portion 184 that is formed at the top end of the extended portion 180 and that may be brought into contact with the shaft portion 176A.

An end of each of the contact portions 184 is bent, and each of the contact portions 184 has a contact surface 184A that may be brought into contact with the shaft portion 176A from below in the top-bottom direction of the image forming apparatus.

As illustrated in FIG. 8A, the contact surfaces 184A are inclined with respect to a movement direction of the driven roller 176 (the top-bottom direction of the image forming apparatus in the second exemplary embodiment). The contact member 156 is moved to the contact position, so that the contact surfaces 184A are brought into contact with the shaft portion 176A, and the retracting portions 168 lifts up the shaft portion 176A. As a result, the driven roller 176 is positioned at the separation position. On the other hand, the contact member 156 is positioned at the retracting position, so that, as illustrated in FIG. 98B, the contact surfaces 184A are separated from the shaft portion 176A, and the driven roller 176 is moved to the contact position by an urging force of the coil springs 158.

In this configuration, in a state where the connecting portion 166 is in contact with the positioning bar 112, as illustrated in FIG. 8A, the contact member 156 is positioned at the contact position, and the driven roller 176 is positioned at the separation position. The leading end of the sheet member P, which is transported by the pair of transport rollers 72, passes between the driven roller 176 and the driving roller 174 and is brought into contact with the contact surfaces 162A of the inclined projecting portions 162.

On the other hand, in a state where the connecting portion 166 is in contact with the positioning bar 114 by rotating the contact member 156, as illustrated in FIG. 9B, the contact member 156 is positioned at the retracting position, and the driven roller 176 is positioned at the contact position.

[Others]

As illustrated in FIG. 12, a torque limiter 170 is disposed between a cylindrical portion 160A that is the cylindrical portion 160 positioned in the middle among the three cylindrical portions 160 and the shaft portion 174A. The torque limiter 170 is an example of a forward transmission member that transmits a rotational force of the shaft portion 174A that rotates in the normal direction to the cylindrical portion 160A and stops transmitting the rotational force when the rotational force, which is to be transmitted, becomes larger than a predetermined force. Note that a one-way clutch (not illustrated) is disposed between the cylindrical portion 160A and the torque limiter 170, so that a rotational force of the shaft portion 174A that rotates in the opposite direction will not be transmitted to the cylindrical portion 160A.

As illustrated in FIG. 8A and FIG. 12, three coil springs 186 that are examples of urging members and that urge the connecting portion 166 toward the side of the positioning bar 112 in such a manner that the contact member 156 is positioned at the contact position are provided. The three coil springs 186 are arranged next to each other in the depth direction of the image forming apparatus, and an end of each of the coil springs 186 is in contact with the connecting portion 166. An urging force that is generated by the three coil springs 186 urging the contact member 156 toward the contact position is larger than an urging force that is generated by the two coil springs 158 urging the driven roller 176 toward the contact position.

Note that the configuration of the controller 172 will be described together with effects of the configuration of a principal portion, which will be described below.

(Effects of Configuration of Principal Portion)

Effects of the transport mechanism 150 and the like will now be described.

First, when the image forming apparatus 10 is not in operation, rotation of the pair of transport rollers 72 and the pair of registration rollers 154 is stopped, and as illustrated in FIG. 8A, the contact member 156 is positioned at the contact position by the urging force of the coil springs 186, and the driven roller 176 is positioned at the separation position (an initial state).

When the image forming apparatus 10 is operating and transports the sheet member P to downstream in the sheet transport direction, as illustrated in FIG. 8B, the controller 172 causes the driving source 90 (see FIG. 6) to operate and causes the pair of transport rollers 72 to rotate in the normal direction. Then, the leading end of the sheet member P, which is transported by the pair of transport rollers 72, passes between the driven roller 176 and the driving roller 174 and is brought into contact with the contact surfaces 162A of the inclined projecting portions 162.

The controller 172 causes the pair of transport rollers 72 to further rotate in a state where the leading end of the sheet member P is in contact with the contact surfaces 162A as illustrated in FIG. 9A. As a result, the sheet member P having the leading end thereof in contact with the contact surfaces 162A is lifted up between the pair of transport rollers 72 and the pair of registration rollers 154 in such a manner as to have a loop shape, and the leading end of the sheet member P is pressed against the contact surfaces 162A.

The controller 172 receives sensed information that is obtained by the sensor 78 by sensing the leading end of the sheet member P, and after the leading end of the sheet member P has been pressed against the contact surfaces 162A for a predetermined period of time from the time when the controller 172 receives the sensed information, the controller 172 causes the driving source 90 not to operate and stops the rotation of the pair of transport rollers 72. The leading end of the sheet member P is pressed against the contact surfaces 162A in this manner, and as a result, inclination of the sheet member P, which is transported, (the inclination of the sheet member P with respect to the transport direction of the sheet member P) is corrected.

In addition, as illustrated in FIG. 9B, the controller 172 causes the driving source 90 and the driving source 192 (see FIG. 6) to operate in accordance with the timing of transferring toner images onto the sheet member P whose inclination has been corrected and causes the pair of transport rollers 72 and the pair of registration rollers 154 to rotate in the normal direction.

The pair of registration rollers 154 are caused to rotate in the normal direction, so that a rotational force in the normal direction is transmitted from the shaft portion 174A to the contact member 156 via the torque limiter 170.

The rotational force in the normal direction is transmitted to the contact member 156, so that the contact member 156 rotates in the normal direction against the urging force of the coil springs 186, and the connecting portion 166 is brought into contact with the positioning bar 114. As a result, transmission of the rotational force from the torque limiter 170 is released, and the contact member 156 and the driven roller 176 are positioned at the retracting position at which the contact member 156 allows the sheet member P to be transported and the contact position, respectively.

The pair of transport rollers 72 and the pair of registration rollers 154 rotate in a state where the contact member 156 is positioned at the retracting position, so that, as illustrated in FIG. 9B and FIG. 10A, the sheet member P is transported to downstream in the sheet transport direction.

Figure 10B:
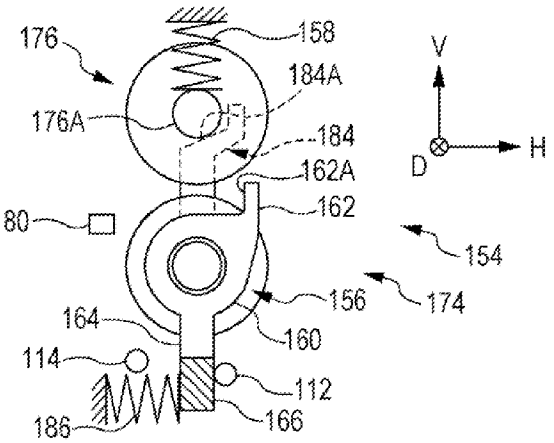
Figure 10B:
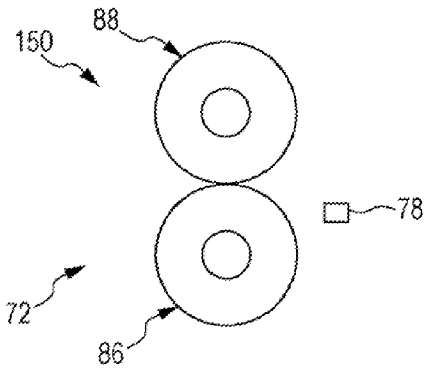

The controller 172 receives sensed information that is obtained by the sensor 80 by sensing the trailing end of the sheet member P, and after a period of time required for the sheet member P to be sent out from the pair of registration rollers 154 has passed from the time when the controller 172 receives the sensed information, as illustrated in FIG. 10B, the controller 172 causes the driving source 90 and the driving source 192 not to operate and stops the rotation of the pair of transport rollers 72 and the pair of registration rollers 154.

The rotation of the pair of registration rollers 154 is stopped, so that the contact member 156 is moved to the contact position by the urging force of the coil springs 186. In other words, stopping the rotation of the pair of registration rollers 154 makes the contact member 156 that has been positioned at the retracting position move to the contact position. In this manner, the transport mechanism 150 is recovered to the initial state.

The above-described process is repeated, so that a predetermined number of the sheet members P whose inclination has been corrected are transported to downstream in the sheet transport direction.

Other effects of the second exemplary embodiment are similar to those of the first exemplary embodiment.

Note that although specific exemplary embodiments of the present invention have been described in detail, the present invention is not limited to the exemplary embodiments, and it is obvious to those skilled in the art that the present invention may employ other various exemplary embodiments within the scope of the present invention. For example, although the transport mechanisms 70 and 150 are used in the image forming apparatus 10 in the above-described exemplary embodiments, the present invention is not limited to these, and the transport mechanisms 70 and 150 of the exemplary embodiments of the present invention may be employed in apparatuses that transport the sheet member P while correcting inclination of the sheet member P. Examples of such apparatuses are automatic teller machines (ATM) of banks, ticket machines at train stations, vending machines, and the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transport mechanism comprising:

a transport path along which a recording medium is transported;

a contact member with which a leading end of the recording medium, which is to be transported along the transport path, is brought into contact, the contact member being capable of moving to a contact position at which the leading end of the recording medium is brought into contact with the contact member or to a retracting position at which the contact member retracts from the transport path, wherein the contact member includes an upward projecting portion located at a top portion of the contacting member in a vertical direction when the contacting member is in the retracting position, and a lower projecting portion located at a bottom portion of the contacting member in the vertical direction when the contacting member is in the retracting position, the upward projecting portion of the contacting member contacting the leading end of the recording medium when in the contact position;

a transport member that transports the recording medium, which has been brought into contact with the contact member, to downstream in a transport direction of the recording medium while the transport member rotating in a normal direction; and a rotational force transmission member that transmits a rotational force of the transport member to the contact member and causes the contact member to move to the contact position or the retracting position.

2. The transport mechanism according to claim 1, wherein the rotational force transmission member functions as a forward transmission member that transmits a rotational force of the transport member, which rotates in the normal direction, to the contact member and causes the contact member that has been positioned at the contact position to move to the retracting position.

3. The transport mechanism according to claim 2, wherein the rotational force transmission member functions as a backward transmission member that transmits a rotational force of the transport member, which rotates in a direction opposite to the normal direction, to the contact member and causes the contact member that has been positioned at the retracting position to move to the contact position.

4. The transport mechanism according to claim 3, wherein the transport member includes a pair of rotary members and transports the recording medium by nipping the recording medium with the pair of rotary members and causing the pair of rotary members to rotate, and wherein a surface of the contact member with which the leading end of the recording medium is brought into contact is positioned further upstream than a contact position at which the pair of rotary members are in contact with each other in the transport direction.

5. The transport mechanism according to claim 2, further comprising:

an urging member that urges the contact member in such a manner that the contact member is positioned at the contact position, wherein, in a state where the transport member is not rotating, the contact member is positioned at the contact position by an urging force of the urging member.

6. The transport mechanism according to claim 5, wherein the transport member includes a pair of rotary members and transports the recording medium by nipping the recording medium with the pair of rotary members and causing the pair of rotary members to rotate, and wherein a surface of the contact member with which the leading end of the recording medium is brought into contact is positioned further upstream than a contact position at which the pair of rotary members are in contact with each other in the transport direction.

7. The transport mechanism according to claim 2, wherein the transport member includes a pair of rotary members and transports the recording medium by nipping the recording medium with the pair of rotary members and causing the pair of rotary members to rotate, and wherein a surface of the contact member with which the leading end of the recording medium is brought into contact is positioned further upstream than a contact position at which the pair of rotary members are in contact with each other in the transport direction.

8. The transport mechanism according to claim 1, wherein the rotational force transmission member functions as a backward transmission member that transmits a rotational force of the transport member, which rotates in a direction opposite to the normal direction, to the contact member and causes the contact member that has been positioned at the retracting position to move to the contact position.

9. The transport mechanism according to claim 8, wherein the transport member includes a pair of rotary members and transports the recording medium by nipping the recording medium with the pair of rotary members and causing the pair of rotary members to rotate, and wherein a surface of the contact member with which the leading end of the recording medium is brought into contact is positioned further upstream than a contact position at which the pair of rotary members are in contact with each other in the transport direction.

10. The transport mechanism according to claim 1, further comprising:

an urging member that urges the contact member in such a manner that the contact member is positioned at the contact position, wherein, in a state where the transport member is not rotating, the contact member is positioned at the contact position by an urging force of the urging member.

11. The transport mechanism according to claim 10, wherein the transport member includes a pair of rotary members and transports the recording medium by nipping the recording medium with the pair of rotary members and causing the pair of rotary members to rotate, and wherein a surface of the contact member with which the leading end of the recording medium is brought into contact is positioned further upstream than a contact position at which the pair of rotary members are in contact with each other in the transport direction.

12. The transport mechanism according to claim 1, wherein the transport member includes a pair of rotary members and transports the recording medium by nipping the recording medium with the pair of rotary members and causing the pair of rotary members to rotate, and wherein a surface of the contact member with which the leading end of the recording medium is brought into contact is positioned further upstream than a contact position at which the pair of rotary members are in contact with each other in the transport direction.

13. An image forming apparatus comprising:

the transport mechanism according to claim 1; and a transfer member that transfers an image onto a recording medium that is to be transported by the transport mechanism.

14. The transport mechanism according to claim 1, further comprising a connecting portion located at a lowest portion of the lower projecting portion, the lowest edge of the connecting portion configured to be substantially horizontal in the retracting position.

* * * * *